US010422201B2

(12) United States Patent
Green et al.

(10) Patent No.: US 10,422,201 B2
(45) Date of Patent: Sep. 24, 2019

(54) DIAMOND TIPPED CONTROL VALVE USED FOR HIGH TEMPERATURE DRILLING APPLICATIONS

(71) Applicants: Ryan Damont Green, League City, TX (US); Sebastian Tegeler, Hannover (DE); Andreas Peter, Celle Niedersachsen (DE); Thomas Kruspe, Wietzendorf (DE)

(72) Inventors: Ryan Damont Green, League City, TX (US); Sebastian Tegeler, Hannover (DE); Andreas Peter, Celle Niedersachsen (DE); Thomas Kruspe, Wietzendorf (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/373,084

(22) Filed: Apr. 2, 2019

(65) Prior Publication Data

US 2019/0226331 A1 Jul. 25, 2019

Related U.S. Application Data

(63) Continuation-in-part of application No. 15/066,612, filed on Mar. 10, 2016.

(51) Int. Cl.
*E21B 34/06* (2006.01)

(52) U.S. Cl.
CPC ..... *E21B 34/066* (2013.01)

(58) Field of Classification Search
CPC ..... E21B 47/18; E21B 47/185; E21B 34/14
See application file for complete search history.

(56) References Cited

U.S. PATENT DOCUMENTS 2,278,532 A 4/1942 Crickmer
3,065,416 A 11/1962 Jeter
(Continued)

FOREIGN PATENT DOCUMENTS

EP 0088402 A2 9/1983
JP 2003097756 A 4/2003
(Continued)

OTHER PUBLICATIONS

Notification of Transmittal of the International Search Report and the Written Opinion of the International Searching Authority PCT/US2017/021329; dated May 10, 2017; 12 pages.
(Continued)

*Primary Examiner* — Munear T Akki
(74) *Attorney, Agent, or Firm* — Cantor Colburn LLP

(57) ABSTRACT

A control valve assembly for use in a wellbore includes a body having a fluid inlet and a fluid outlet. A portion of the body is formed from magnetic material. A plunger is mounted within the body. A portion of the plunger is formed from a magnetic material. A magnetic circuit having a gap is defined within the control valve assembly. The portion of the body formed from magnetic material defines a first portion of the magnetic circuit and the portion of the plunger formed from magnetic material forms another portion of the magnetic circuit. A solenoid is mounted at the body. The solenoid is selectively activated to create a magnetic field across the gap in the magnetic circuit. The magnetic field causes the plunger to shift, narrowing the gap disengaging from the one of the fluid inlet and the fluid outlet to produce a pressure pulse in the wellbore.

25 Claims, 5 Drawing Sheets

(56) References Cited

U.S. PATENT DOCUMENTS

| | | | | |
|---|---|---|---|---|
| 3,523,676 | A | 8/1970 | Barker | |
| 3,958,217 | A | 5/1976 | Spinnler | |
| 3,964,556 | A | 6/1976 | Gearhart | |
| 4,078,620 | A | 5/1978 | Westlake | |
| 4,336,564 | A | 6/1982 | Wisniewski et al. | |
| 4,351,037 | A | 9/1982 | Scherbatskoy | |
| 4,386,422 | A | 5/1983 | Mumby | |
| 4,515,225 | A | 5/1985 | Dailey | |
| 4,550,392 | A | 10/1985 | Mumby | |
| 4,628,495 | A | 12/1986 | Peppers | |
| 4,719,979 | A * | 1/1988 | Jones | E21B 10/602 175/430 |
| 4,819,745 | A | 4/1989 | Walter | |
| 4,825,421 | A | 4/1989 | Jeter | |
| 4,873,488 | A * | 10/1989 | Barber | E21B 17/003 324/339 |
| 5,070,595 | A | 12/1991 | Perkins et al. | |
| 5,073,877 | A | 12/1991 | Jeter | |
| 5,103,430 | A | 4/1992 | Jeter et al. | |
| 5,182,731 | A | 1/1993 | Hoelscher | |
| 5,275,337 | A | 1/1994 | Kolarik et al. | |
| 5,303,776 | A | 4/1994 | Ryan | |
| 5,333,686 | A | 8/1994 | Vaughan | |
| 5,660,238 | A | 8/1997 | Earl | |
| 6,002,643 | A | 12/1999 | Tchakarov | |
| 6,016,288 | A | 1/2000 | Frith | |
| 6,199,823 | B1 | 3/2001 | Dahlgren et al. | |
| 6,328,112 | B1 | 12/2001 | Malone | |
| 6,464,011 | B2 | 10/2002 | Tubel | |
| 6,555,926 | B2 | 4/2003 | Gondron | |
| 6,626,244 | B2 | 9/2003 | Powers | |
| 6,714,138 | B1 | 3/2004 | Turner | |
| 6,811,135 | B2 | 11/2004 | Moreno et al. | |
| 6,898,150 | B2 | 5/2005 | Hahn | |
| 7,350,588 | B2 | 4/2008 | Simpson et al. | |
| 7,921,876 | B2 | 4/2011 | Wright et al. | |
| 8,365,821 | B2 | 2/2013 | Hall et al. | |
| 8,469,104 | B2 | 6/2013 | Downton | |
| 8,534,381 | B1 | 9/2013 | Rinald | |
| 8,627,883 | B2 | 1/2014 | Richards | |
| 8,627,893 | B2 | 1/2014 | Otto et al. | |
| 8,640,768 | B2 | 2/2014 | Hall et al. | |
| 8,672,025 | B2 | 3/2014 | Wolf et al. | |
| 8,905,075 | B2 | 12/2014 | Tower | |
| 8,912,915 | B2 | 12/2014 | Hay et al. | |
| 2002/0117644 | A1 | 8/2002 | Carrillo et al. | |
| 2003/0024706 | A1 | 2/2003 | Allamon | |
| 2003/0047317 | A1* | 3/2003 | Powers | E21B 17/003 166/373 |
| 2004/0069530 | A1 | 4/2004 | Prain | |
| 2007/0056771 | A1 | 3/2007 | Gopalan et al. | |
| 2008/0236841 | A1 | 10/2008 | Howlett et al. | |
| 2008/0236842 | A1 | 10/2008 | Bhavsar et al. | |
| 2009/0009174 | A1* | 1/2009 | Forgang | G01V 3/28 324/338 |
| 2009/0114396 | A1 | 5/2009 | Kusko et al. | |
| 2010/0089587 | A1 | 4/2010 | Stout | |
| 2010/0102264 | A1 | 4/2010 | Bickoff et al. | |
| 2010/0195442 | A1 | 8/2010 | Reyes et al. | |
| 2010/0272587 | A1* | 10/2010 | Stoddard | F04B 43/073 417/375 |
| 2011/0155392 | A1 | 6/2011 | Frazier | |
| 2011/0232791 | A1 | 9/2011 | Bengea et al. | |
| 2011/0278017 | A1 | 11/2011 | Themig et al. | |
| 2012/0118582 | A1 | 5/2012 | Soni et al. | |
| 2012/0261603 | A1 | 10/2012 | Kahn et al. | |
| 2012/0279723 | A1 | 11/2012 | Hofman | |
| 2014/0034325 | A1 | 2/2014 | Jancha et al. | |
| 2014/0284112 | A1 | 9/2014 | Cenac et al. | |
| 2014/0332277 | A1 | 11/2014 | Churchill | |
| 2015/0034386 | A1 | 2/2015 | Reed et al. | |
| 2015/0260014 | A1* | 9/2015 | Zimmerman | E21B 41/0085 166/373 |
| 2015/0322753 | A1 | 11/2015 | Zimmerman, Jr. | |
| 2016/0265350 | A1 | 9/2016 | Brown-Kerr et al. | |
| 2016/0341001 | A1* | 11/2016 | Scholz | E21B 47/185 |
| 2017/0260831 | A1 | 9/2017 | Green | |
| 2017/0260832 | A1 | 9/2017 | Green et al. | |
| 2017/0260852 | A1 | 9/2017 | Green et al. | |

FOREIGN PATENT DOCUMENTS

| | | | |
|---|---|---|---|
| WO | 2014094150 | A1 | 6/2014 |
| WO | 2015017522 | A1 | 2/2015 |

OTHER PUBLICATIONS

Notification of Transmittal of the International Search Report and the Written Opinion of the International Searching Authority, or the Declaration; PCT/US2017/021327; dated May 10, 2017; 15 pages.

Notification of Transmittal of the International Search Report and the Written Opinion of the International Searching Authority, or the Declaration; PCT/US2017/021331; dated May 31, 2017; 13 pages.

Schlumberger, "High Temperature Drilling Operations", Retrieved from: https://www.slb.com/~/media/Files/drilling/brochures/drilling_applications/ht_tools_br.pdf; "An Industry Challenge" In 1-9: High temperatures can cause severe damage . . . .

* cited by examiner

DIAMOND TIPPED CONTROL VALVE USED FOR HIGH TEMPERATURE DRILLING APPLICATIONS

CROSS REFERENCE TO RELATED APPLICATIONS

This application claims the benefit of an earlier filing date from U.S. Non-provisional application Ser. No. 15/066,612 filed Mar. 10, 2016, the entire disclosure of which is incorporated herein by reference.

BACKGROUND

Downhole operations often include a downhole string that extends from an uphole system into a formation. The uphole system may include a platform, pumps, and other systems that support drilling operations, resource exploration, development, and extraction. In some instances, fluids may be passed from the uphole system into the formation through the downhole string. In other instances, fluid may pass from the formation through the downhole string to the uphole system. The downhole string may include various sensors that detect downhole parameters including formation parameters and parameters associated with the downhole string.

It is desirable to communicate information from downhole sensors to the uphole system. Communication may take place through wired, optical, or acoustical systems. Acoustical systems rely upon passage of pressure pulses generated downhole by a mud pulser to an uphole receiver. The pressure pulses are created by moving a piston into a choke valve in order to create an additional temporarily pressure increase at the pump system on the surface. The generated pressure pulse travels to the surface. The uphole receiver converts the pressure pulses to data indicative of sensed parameters. The pressure pulses provide useful information to uphole operators.

During drilling, a typical mud pulser substantially continuously generates pressure pulses over long time periods, often several days. In addition, a number of wellbores are currently drilled in formations having temperatures that are above 300° F. (149° C.). A majority of currently utilized mud pulsers include oil fillings, elastomers and/or electrical high pressure connectors, all of which tend to deteriorate over time and thus are not suitable for use in high temperature environments. The disclosure herein provides pulsers that are suitable for high temperature environments while also being made without oil fillings, elastomers or electrical high pressure connectors.

SUMMARY

Disclosed is a control valve assembly for use in a downhole tool in a wellbore including a body having a fluid passage including a fluid inlet and a fluid outlet. A portion of the body is formed from magnetic material. A plunger is slidingly mounted within the body. The plunger is selectively engaged with one of the fluid inlet and the fluid outlet. A portion of the plunger is formed from a magnetic material. A magnetic circuit having a gap is defined within the control valve assembly. The portion of the body formed from magnetic material defines a first portion of the magnetic circuit and the portion of the plunger formed from magnetic material forms another portion of the magnetic circuit. A solenoid is mounted at the body about at least a part of the magnetic material of at least one of the body and the plunger. The solenoid is selectively activated to create a magnetic field across the gap in the magnetic circuit. The magnetic field causes the plunger to shift, narrowing the gap and disengaging from the one of the fluid inlet and the fluid outlet to produce a pressure pulse in the wellbore.

Also disclosed is a drilling system including an uphole system and a downhole system including a downhole string operatively connected to the uphole system. The downhole string includes a pulser alternator generator having a main valve assembly, an alternator, and a control valve assembly operatively connected to the main valve assembly and the alternator. The control valve assembly includes a body having a fluid passage including a fluid inlet and a fluid outlet. A portion of the body is formed from magnetic material. A plunger is slidingly mounted within the body. The plunger is selectively engaged with one of the fluid inlet and the fluid outlet. A portion of the plunger is formed from a magnetic material. A magnetic circuit having a gap is defined within the control valve assembly. The portion of the body formed from magnetic material defines a first portion of the magnetic circuit and the portion of the plunger formed from magnetic material forms another portion of the magnetic circuit. A solenoid is mounted at the body about at least a part of the magnetic material of at least one of the body and the plunger. The solenoid is selectively activated to create a magnetic field across the gap in the magnetic circuit. The magnetic field causes the plunger to shift, narrowing the gap and disengaging from the one of the fluid inlet and the fluid outlet to produce a pressure pulse.

Further disclosed is a method of creating a mud pulse in a downhole tool including activating a solenoid to form a magnetic flux across a gap in a magnetic circuit formed within a control valve assembly, narrowing the gap by moving a plunger in the control valve assembly in response to the magnetic flux, uncovering one of a fluid inlet and a fluid outlet creating a mud pulse by moving the plunger, and deactivating the solenoid to cut off the magnetic flux to expand the gap.

BRIEF DESCRIPTION OF THE DRAWINGS

Referring now to the drawings wherein like elements are numbered alike in the several Figures.

DETAILED DESCRIPTION

Figure 1:
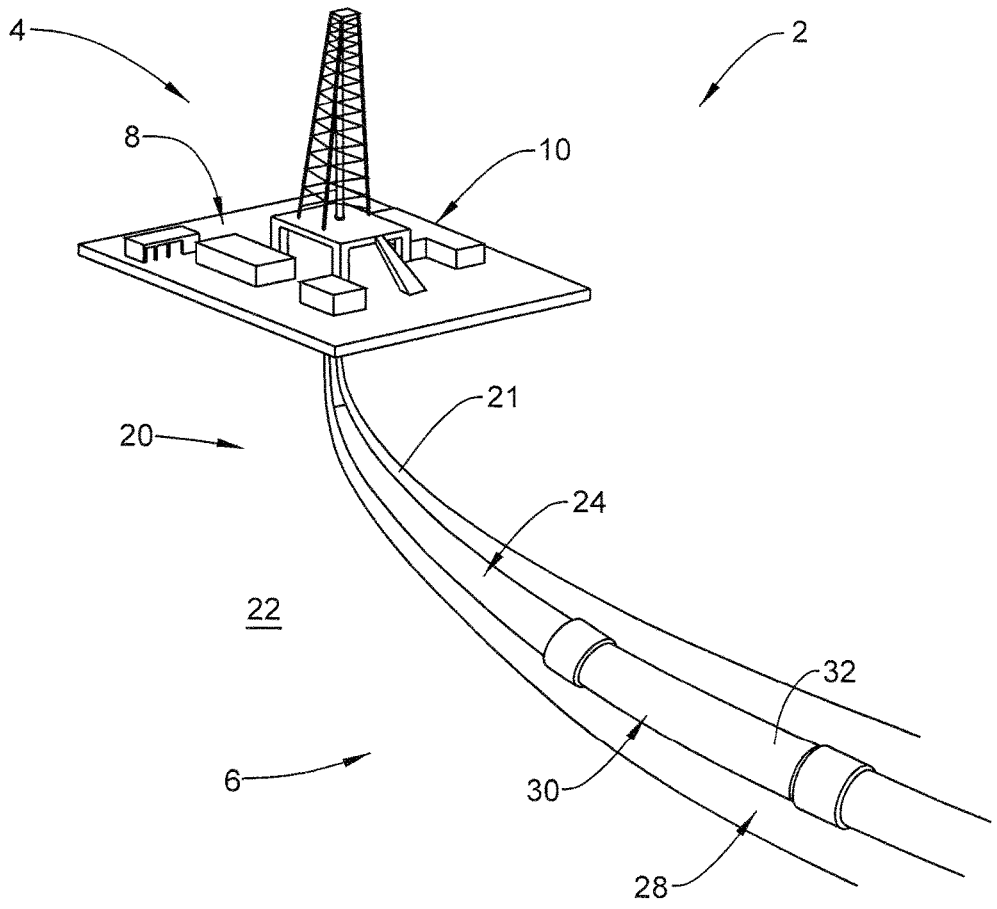
FIG. 1 depicts a drilling system having an uphole system operatively connected to a downhole string including a pulser alternator generator (PAG) having a plunger-type control valve assembly, in accordance with an exemplary embodiment.

A drilling system (e.g., a resource exploration and/or recovery system), in accordance with an exemplary embodiment, is indicated generally at 2, in FIG. 1. Drilling system 2 should be understood to include well drilling operations, resource extraction and recovery, $CO_2$ sequestration, and the like. Drilling system 2 may include an uphole system 4 operatively connected to a downhole system 6. Uphole system 4 may include pumps 8 that aid in completion and/or extraction processes as well as fluid storage 10. Fluid storage 10 may contain a gravel pack fluid or slurry (not shown) that is introduced into downhole system 6.

Downhole system 6 may include a downhole string 20 that is extended into a wellbore 21 formed in formation 22. Downhole string 20 may include a number of connected downhole tools or tubulars 24. One of tubulars 24 may include a pulser alternator generator (PAG) assembly 28. PAG assembly 28 may receive signals from one or more sensors (not shown) indicating one or more of formation parameters, downhole fluid parameters, tool condition parameters and the like. PAG assembly 28 creates one or more pressure pulses that are received at uphole system 4. The one or more pressure pulses define a code that may contain information regarding data received by the sensors. In accordance with an exemplary embodiment, PAG assembly 28 creates pressure pulses by selectively stopping a flow of pressurized downhole fluid or mud as will be detailed more fully below.

Figure 2:
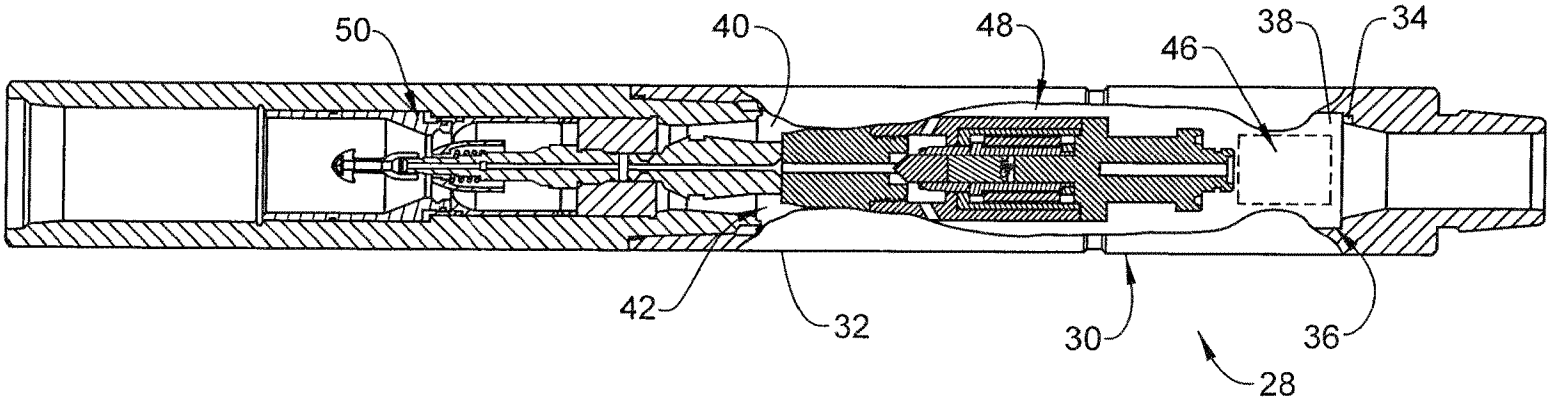
FIG. 2 depicts a partial cross-sectional view of the PAG of FIG. 1.

In accordance with an exemplary embodiment illustrated in FIG. 2, PAG assembly 28 includes a body portion 30 having an outer surface portion 32 and an inner portion 34. An inner housing 36 is arranged within inner portion 34. Inner housing 36 includes an outer surface 38 and an inner surface 40 that defines an interior portion 42. Interior portion 42 houses an alternator assembly 46, a control valve assembly (CVA) 48, and a main valve assembly 50 having a mud flow inlet portion (not separately labeled) and a mud flow outlet portion (also not separately labeled). As will be detailed more fully below, alternator assembly 46 provides signals to CVA 48 that allow drilling mud to flow through MVA 50. CVA 48 creates pressure pulses in the mud flow that provide downhole data from sensors (not shown) operatively coupled to alternator assembly 46 to uphole operators. In this disclosure the term "mud flow" is used synonymous with the term "fluid".

Figure 3:
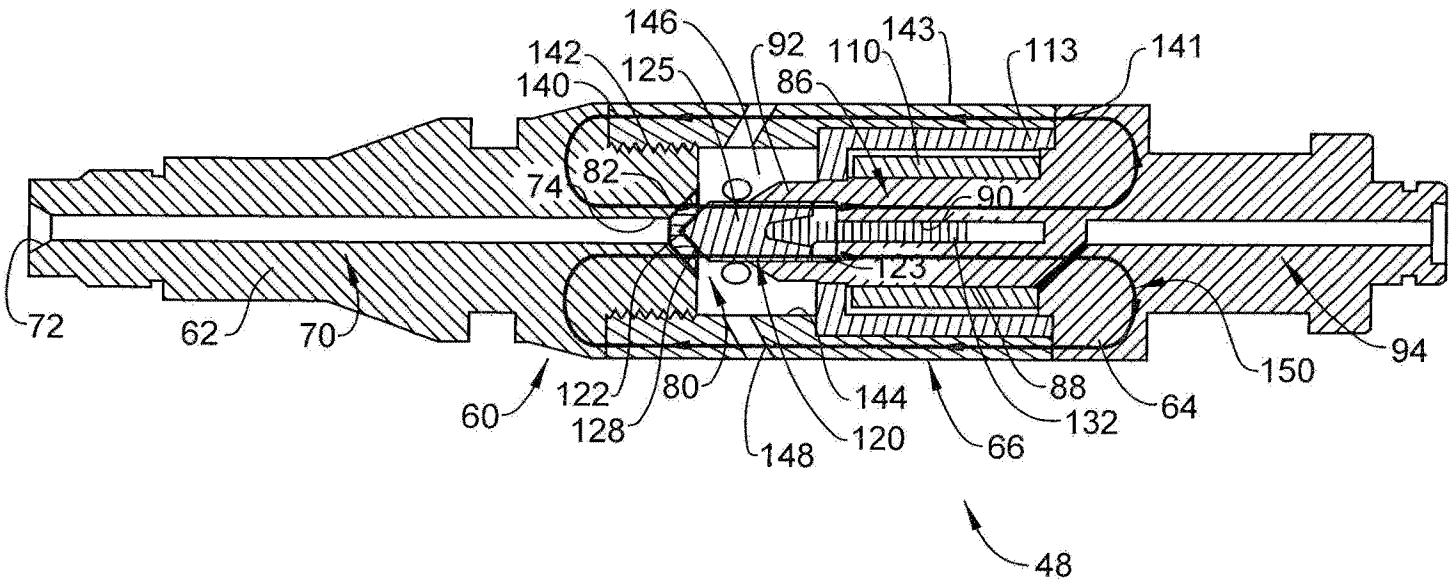
FIG. 3 depicts a cross-sectional view of the control valve assembly of FIG. 2, in accordance with an aspect of an exemplary embodiment.

As shown in FIG. 3, CVA 48 includes a body 60 having a first body portion 62 mechanically linked to a second body portion 64 by a sleeve member 66. First and second body portions 62 and 64 as well as sleeve member 66 may be formed from a magnetic material, such as a soft magnetic material, e.g., Vacoflux 9CR from Vacuumschmelze GmbH and Co. Magnetic and soft-magnetic materials are defined as having a magnetic permeability μ that is greater than about $1.26*10^{-4}$ $N/A^2$ (ferromagnetic or ferrimagnetic material). The magnetic or soft-magnetic material may also be corrosion resistant. In this manner, first and second body portions 62 and 64 and sleeve member 66 may withstand prolonged exposure to downhole fluids. First body portion 62 includes a mud flow or fluid passage 70 having a mud flow inlet 72 fluidically connected to MVA 50 and a mud flow outlet 74. At this point, it should be understood that the term magnetic material comprises any suitable material that may form part of a magnetic circuit including soft magnetic material.

A valve seat 80 is arranged at mud flow outlet 74. Valve seat 80 includes a taper 82. Second body portion 64 includes a plunger support 86 having an outer surface section 88 and a central passage 90. Plunger support 86 also includes a cantilevered end portion (not separately labeled) that defines a valve carrier 92. Second body portion 64 is also shown to include a conductor passage 94. A solenoid 110 is supported on plunger support 86. Solenoid 110 is operatively connected to alternator assembly 46 through a conductor (not shown) extending through conductor passage 94. Solenoid 110 is surrounded by a housing 113 that may take the form of a pressure sleeve. Housing 113 may be formed from a corrosion resistant high strength non-magnetic material such as Inconel to provide protection from corrosive high pressured downhole fluids.

CVA 48 also includes a plunger 120 slidingly supported relative to plunger support 86. Plunger 120 includes a first end portion 122, a second end portion 123 and an intermediate portion 125 extending therebetween. First end portion 122 includes a tapered surface 128 that is selectively received by taper 82 of valve seat 80. Plunger 120 may be formed from a magnetic or soft-magnetic material. Further, plunger 120 may include a diamond coating to improve wearability. An actuation rod 132 may be supported at second end portion 123.

Sleeve member 66 includes a first end section 140 and a second end section 141. First end section 140 includes a plurality of threads 142 that engage with first body portion 62. Second end section 141 may be welded or press fit to second body portion 64. Of course, it should be understood that the type of attachment to first and second body portions 62 and 64 may vary. Sleeve member 66 also includes an outer surface 143 and an inner surface 144 that defines, at least in part, a mud flow outlet chamber 146. A plurality of outlet ports 148 extend from inner surface 144 through outer surface 143. Outlet ports 148 allow mud to flow through mud flow passage 70, into mud flow outlet chamber 146 and be directed onto inner surface 40 of housing 36.

In accordance with an aspect of an exemplary embodiment, outlet ports 148 may extend at an angle of between about 20° and about 80° relative to a longitudinal axis (not separately labeled) of CVA 48. In accordance with another aspect, outlet ports 148 may extend at an angle of about 60° relative to the longitudinal axis. In this manner, impact forces associated with pulses of mud passing from outlet ports 148 onto inner surface 40 may be reduced over those which would be realized if outlet ports 148 extended perpendicularly to the longitudinal axis.

With this arrangement, alternator assembly 46 provides signals to selectively activate and de-activate solenoid 110. Activating and deactivating solenoid 110 establishes and disrupts a magnetic circuit (not separately labeled) that affects a magnetic flux 150 acting on plunger 120 to create a pulse. At this point, it should be understood that the term "magnetic circuit" defines a pathway of material within CVA 48 through which magnetic flux 150 will flow. The magnetic circuit, in the embodiment shown, may include first body portion 62, second body portion 64, sleeve member 66, plunger support 86, and plunger 120. In an embodiment, the opening of the magnetic circuit allows plunger 120 to move away from valve seat 80 thereby allowing mud flow pressure to shift magnetic plunger 120 from the first or closed position (FIG. 3) to a second or open position. Solenoid 110 may then be activated to return plunger 120 to the first position.

In the second position, mud may flow through mud flow outlet 74, into mud flow outlet chamber 146 and be expelled through outlet ports 148. When CVA 48 is operated rapidly, MVA 50 creates mud pulses that travel through downhole string 20. In most downhole applications the solenoid will only be activated when a mud pulse is to be created. An idle position will be the valve open or second position, solenoid deactivated. In this position, mud flows through outlet 74 into mud flow outlet chamber 146 (fluid outlet chamber). The mud pulse created when the solenoid is activated will be a positive mud pulse. An uphole receiver captures pressure waves created by the pulses of mud. The pressure pulses are presented in a pattern dictated by signals received at alternator assembly 46 from one or more sensors or one or more processors in the downhole string. The pressure pulses may be decrypted to provide data regarding one or more downhole parameters to uphole operators.

Figure 4:
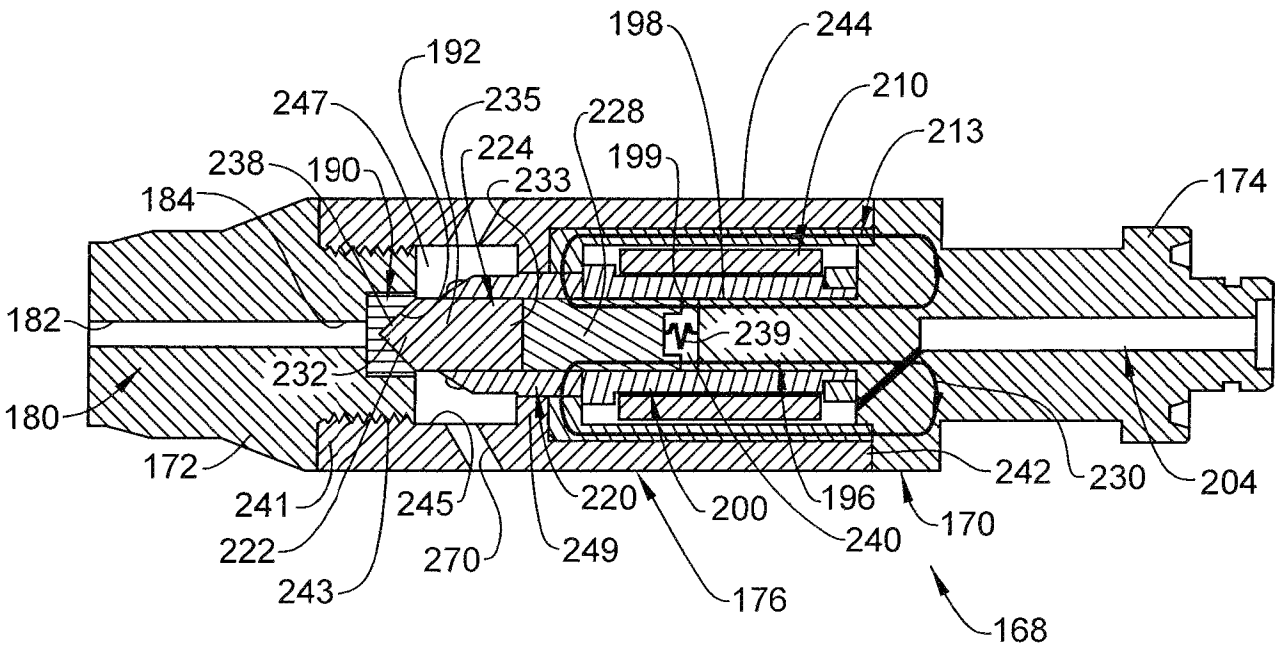
FIG. 4 depicts a cross-sectional view of a plunger-type control valve in a closed configuration, in accordance with an aspect of an exemplary embodiment.

Reference will now follow to FIG. 4 in describing a control valve assembly (CVA) 168 in accordance with another aspect of an exemplary embodiment. CVA 168 takes the form of a reverse plunger system, e.g., a plunger that opens a flow port when acted upon creating a magnetic flux in a magnetic circuit. CVA 168 includes a body 170 having a first body portion 172 mechanically linked to a second body portion 174 by a sleeve member 176. First body portion 172 and sleeve member 176 may be formed from a high-strength non-magnetic material such as steel including treated steel, or other wear resistant materials or alloys such as Inconel. Second body portion 174 may be formed from a magnetic or soft magnetic material such as Vacoflux® 9CR. The magnetic or soft magnetic material may also be corrosion resistant. At this point, it should be understood that the term magnetic material includes any suitable material that may form part of a magnetic circuit including soft magnetic material.

In this manner, first and second body portions 172 and 174 and sleeve member 176 may withstand prolonged exposure to downhole fluids. First body portion 172 includes a mud flow passage 180 having a mud flow inlet 182 fluidically connected to MVA 50 (FIG. 2) and a mud flow outlet 184. A valve seat 190 is arranged at mud flow outlet 184. Valve seat 190 includes a taper 192. Second body portion 174 includes a plunger support 196 having an outer surface section 198 and an axial end section 199. A solenoid carrier 200, which may be formed from a non-magnetic material, is mounted to plunger support 196. Second body portion 174 is also shown to include a conductor passage 204.

A solenoid 210 is mounted to and/or carried by solenoid carrier 200. Solenoid 210 is operatively connected to alternator assembly 46 (FIG. 2) through a conductor (not shown) extending through conductor passage 204. Solenoid 210 is surrounded by a housing 213 that may take the form of a pressure sleeve. Housing 213 may be formed from a magnetic material, e.g., a soft magnetic material such as 9CR from Vacuumschmelze GmbH and Co. to provide protection from corrosive downhole fluids as well as to form a portion of a magnetic circuit (not separately labeled) as will be detailed herein.

CVA 168 also includes a plunger guide 220 mechanically fixed to solenoid carrier 200. Plunger guide 220 is formed from a magnetic material, e.g., a soft magnetic material, and may form part of the magnetic circuit. Plunger guide 220 slidingly supports a plunger 222 that may include a valve portion 224 and a piston or drive portion 228. Piston portion 228 is formed from magnetic material, e.g., a soft magnetic material, that is responsive to a magnetic field produced by solenoid 210 and will allow a magnetic flow 230. The term "slidingly supported" should be understood to describe that the plunger may move axially within and substantially parallel to a longitudinal axis of body 170 (linear movement).

Valve portion 224 includes a first end portion 232, a second end portion 233 and an intermediate portion 235 extending therebetween. First end portion 232 includes a tapered surface 238 that is received by taper 192 of valve seat 190. Valve portion 224 of plunger 222 may be formed from a diamond coated corrosion resistant and hardened non-magnetic material. A spring 239 may be arranged in a gap 240 defined between axial end section 199 of plunger support 196 and piston portion 228. Spring 239 biases plunger 222 toward valve seat 190. Splitting the plunger in two parts enables valve portion 224 of plunger 222 to be separated from the magnetic circuit. Therefore, valve portion 224 does not need to be made of magnetic material. It may be made of material that is much better suited for harsh downhole conditions, including high temperatures and corrosive and abrasive fluids. The material used to form valve portion 224 of plunger 222 may be hardened steel, diamond, tungsten carbide, carbon nitride, or boron nitride or alternative hard and/or less corrosive materials.

In an embodiment, the reverse plunger system valve portion 224 section may be made from non-magnetic high strength material. That is, as will be detailed herein, in the reverse plunger system valve portion 224 does not form part of the magnetic circuit that is established to shift plunger away from valve seat 190. The valve portion may be made of material that is much better suited for harsh downhole conditions, like high temperatures and corrosive and abrasive fluids. The material of the valve portion of the plunger may be hardened steel, diamond, tungsten carbide, carbon nitride, or boron nitride or alternative hard and/or less corrosive materials. In this manner, the reverse plunger systems is controlled by the closing of the magnetic circuit which leads to a reliable working control valve suitable to withstand harsh environments. The magnetic circuit can be closed in an environment which in not exposed to mud flow. At this point, it should be understood that the term "magnetic circuit" defines a pathway of material within CVA 168 through which magnetic flux 230 will flow. In an embodiment, the magnetic circuit may be defined by second body portion 174, housing 213, plunger guide 220, and drive portion 228. The magnetic circuit creates a magnetic field across gap 240.

Sleeve member 176 includes a first end section 241 and a second end section 242. First end section 241 includes a plurality of threads 243 that engage with first body portion 172. Second end section 242 may be welded to second body portion 174. Of course, it should be understood that the type of attachment to first and second body portions 172 and 174 may vary. Sleeve member 176 also includes an outer surface 244 and an inner surface 245 that defines a mudflow outlet chamber 247.

An annular flange 249 extends radially inwardly from inner surface 245. Annular flange 249, together with housing 213, supports plunger guide 220 which, in turn, slidingly supports plunger 222. A plurality of outlet ports 270 extend from inner surface 245 through outer surface 244. Outlet ports 270 allow mud to flow through mud flow passage 180, into mud flow outlet chamber 247 and be directed onto inner surface 40 of housing 36.

In accordance with an aspect of an exemplary embodiment, outlet ports 270 may extend at an angle of between about 20° and about 80° relative to a longitudinal axis (not separately labeled) of CVA 168. In accordance with another aspect, outlet ports 270 may extend at an angle of about 60° relative to the longitudinal axis. In this manner, impact forces associated with pulses of mud passing from outlet ports 270 onto inner surface 40 may be reduced over those which would be realized if outlet ports 270 extended perpendicularly to the longitudinal axis.

With this arrangement, alternator assembly 46 provides signals to selectively activate solenoid 210 closing a magnetic circuit (not separately labeled) creating magnetic flux 230. The magnetic circuit is defined within CVA 168 and may include second body portion 174, housing 213, plunger guide 220, and plunger 222. In accordance with an aspect, only piston portion 228 of plunger 222 forms part of the magnetic circuit, passing through plunger 222.

Figure 5:
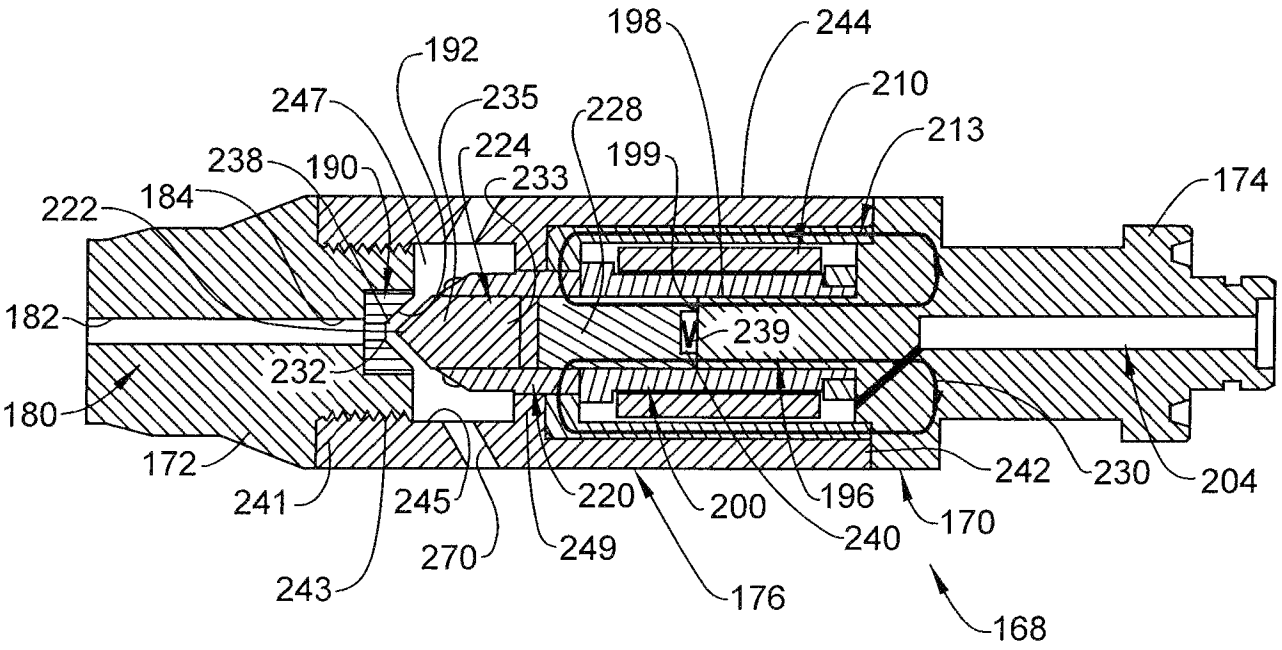
FIG. 5 depicts a cross-sectional view of the plunger-type control valve of FIG. 4 in an open configuration, in accordance with an aspect of an exemplary embodiment.

Magnetic flux 230 passing through the magnetic circuit is formed each time solenoid 210 is energized (electrically powered). Due to a magnetic flux or a magnetic field across the gap 240 leading to magnetic forces that are acting across the gap 240, drive portion of plunger 222 moves from the first or closed position to the second or open position. (FIG. 5) Plunger 222 moves along a longitudinal axis towards plunger support 196. Drive portion 228 and plunger support 196 are attracted to one another due to magnetic flux 230 passing through the magnetic circuit causing a magnetic force acting on the drive portion. The attraction formed between drive portion 228 and plunger support 196 narrows the gap 240 and unseats valve portion 224 from valve seat 190 uncovering mud flow outlet 184. Moving valve portion 224 from valve seat 190 allows mud to flow through mud flow outlet 184 and be expelled through outlet port 270. Thus, each energization of solenoid 210 produces a negative pressure pulse in the drill string. The gap does not need to fully close to open the CVA and to produce a pressure (mud) pulse.

Solenoid 210 may then be de-activated, interrupting the magnetic circuit and to cutting off magnetic flux 230, thereby allowing spring 239 to bias plunger 222 back to the first position, positioning valve portion 224 on valve seat 190 and stopping mud flow through mud flow outlet 184 creating a positive pressure pulse in the drill string. Biasing plunger 222 back to the first position after deactivation of solenoid 210 using spring 239 results in expansion of gap 240. When CVA 48 is operated rapidly, MVA 50 creates mud pulses that travel through downhole string 20. An uphole receiver in uphole system 4 captures pressure waves created by the pulses of mud. The pressure pulses are presented in a pattern dictated by signals received from one or more sensors at alternator assembly 46. The pressure pulses may be decrypted to provide data regarding one or more downhole parameters to uphole operators. In the embodiment of the control valve 168, the solenoid 210 may be placed in a sealed and clean 1-bar environment. In the particular embodiment of the device 168 in FIG. 4, plunger 222 is only part of the control valve 168 that moves when the solenoid is energized. While moving, plunger 222 slides in an environment that is flooded with fluid (mud). The presence of mud allows plunger 222 to slide back and forth with relatively low friction.

Set forth below are some embodiments of the foregoing disclosure:

Embodiment 1

A control valve assembly for use in a downhole tool in a wellbore comprising: a body including a fluid passage having a fluid inlet and a fluid outlet, wherein a portion of the body is formed from magnetic material; a plunger slidingly mounted within the body, the plunger is selectively engaged with one of the fluid inlet and the fluid outlet, wherein a portion of the plunger is formed from a magnetic material; a magnetic circuit having a gap defined within the control valve assembly, wherein the portion of the body formed from magnetic material defines a first portion of the magnetic circuit and the portion of the plunger formed from magnetic material forms another portion of the magnetic circuit; and a solenoid mounted at the body about at least a part of the magnetic material of at least one of the body and the plunger, the solenoid being selectively activated to create a magnetic field across the gap in the magnetic circuit, the magnetic field causing the plunger to shift, narrowing the gap and disengaging from the one of the fluid inlet and the fluid outlet to produce a pressure pulse in the wellbore.

Embodiment 2

The control valve assembly according to any previous embodiment, wherein the plunger includes a tapered surface.

Embodiment 3

The control valve assembly according to any previous embodiment, wherein at least a part of the plunger is formed from at least one of corrosion resistant material and hard material.

Embodiment 4

The control valve assembly according to any previous embodiment, wherein the plunger comprises a valve portion and a drive portion, the valve portion being formed from a non-magnetic material and the drive portion being formed from a soft magnetic material.

Embodiment 5

The control valve assembly according to any previous embodiment, wherein the body includes a first body portion mechanically joined to a second body portion, the first body portion being formed from a first material and the second body portion being formed from a second material that is distinct from the first material.

Embodiment 6

The control valve assembly according to any previous embodiment, wherein the second material is a soft magnetic material.

Embodiment 7

The control valve assembly according to any previous embodiment, further comprising: a sleeve member mechanically linking the first body portion and the second body portion, the sleeve member defining a fluid outlet chamber fluidically connected to the fluid outlet.

Embodiment 8

The control valve assembly according to any previous embodiment, wherein the sleeve member is formed from a non-magnetic material and includes one or more outlet ports fluidically connected with the fluid outlet chamber.

Embodiment 9

The control valve assembly according to any previous embodiment, further comprising: a spring member biasing the plunger toward the one of the fluid inlet and the fluid outlet.

Embodiment 10

The control valve assembly according to any previous embodiment, further comprising: a housing surrounding the solenoid, the housing being formed from a soft magnetic material.

Embodiment 11

The control valve assembly according to any previous embodiment, further comprising: a plunger guide supported in the body, the plunger guide guiding movement of the plunger.

Embodiment 12

A drilling system comprising: an uphole system; and a downhole system including a downhole string operatively connected to the uphole system, the downhole string including a pulser alternator generator having a main valve assembly, an alternator, and a control valve assembly operatively connected to the main valve assembly and the alternator, the control valve assembly comprising: a body including a fluid passage having a fluid inlet and a fluid outlet, wherein a portion of the body is formed from magnetic material; a plunger slidingly mounted within the body, the plunger is selectively engaged with one of the fluid inlet and the fluid outlet, wherein a portion of the plunger is formed from a magnetic material; a magnetic circuit having a gap defined within the control valve assembly, wherein the portion of the body formed from magnetic material defines a first portion of the magnetic circuit and the portion of the plunger formed from magnetic material forms another portion of the magnetic circuit; and a solenoid mounted at the body about at least a part of the magnetic material of at least one of the body and the plunger, the solenoid being selectively activated to create a magnetic field across the gap in the magnetic circuit, the magnetic field causing the plunger to shift, narrowing the gap and disengaging from the one of the fluid inlet and the fluid outlet to produce a pressure pulse.

Embodiment 13

The drilling system according to any previous embodiment, wherein the plunger includes a tapered surface.

Embodiment 14

The drilling system according to any previous embodiment, wherein at least a part of the plunger is formed from at least one of corrosion resistant material and hard material.

Embodiment 15

The drilling system according to any previous embodiment, wherein the plunger comprises a valve portion and a drive portion, the valve portion being formed from a non-magnetic material and the drive portion being formed from a soft magnetic material.

Embodiment 16

The drilling system according to any previous embodiment, wherein the body includes a first body portion mechanically joined to a second body portion, the first body portion being formed from a first material and the second body portion being formed from a second material that is distinct from the first material.

Embodiment 17

The drilling system according to any previous embodiment, wherein the second material is a soft magnetic material.

Embodiment 18

The drilling system according to any previous embodiment, further comprising: a sleeve member mechanically linking the first body portion and the second body portion, the sleeve member defining a fluid outlet chamber fluidically connected to the fluid outlet.

Embodiment 19

The drilling system according to any previous embodiment, wherein the sleeve member is formed from a non-magnetic material and includes one or more outlet ports fluidically connected with the fluid outlet chamber.

Embodiment 20

The drilling system according to any previous embodiment, further comprising: a spring member biasing the plunger toward the one of the fluid inlet and the fluid outlet.

Embodiment 21

The drilling system according to any previous embodiment, further comprising: a housing surrounding the solenoid, the housing being formed from a soft magnetic material.

Embodiment 22

The drilling system according to any previous embodiment, further comprising: a plunger guide supported in the body, the plunger guide guiding movement of the plunger.

Embodiment 23

A method of creating a mud pulse in a downhole tool comprising: activating a solenoid to form a magnetic flux across a gap in a magnetic circuit formed within a control valve assembly; narrowing the gap by moving a plunger in the control valve assembly in response to the magnetic flux; uncovering one of a fluid inlet and a fluid outlet creating a mud pulse by moving the plunger; and deactivating the solenoid to cut off the magnetic flux to expand the gap.

Embodiment 24

The method according to any previous embodiment, wherein uncovering the one of the fluid inlet and the fluid outlet includes shifting a first end portion of the plunger formed from a non-magnetic material off away from the fluid outlet.

Embodiment 25

The method according to any previous embodiment, wherein forming the magnetic flux includes passing the magnetic flux through a second portion of the plunger formed from a magnetic material.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A control valve assembly for use in a downhole tool in a wellbore comprising:

a body including a fluid passage having a fluid inlet and a fluid outlet, wherein a portion of the body is formed from magnetic material;

a plunger slidingly mounted within the body, the plunger is selectively engaged with one of the fluid inlet and the fluid outlet, wherein a portion of the plunger is formed from a magnetic material;

a magnetic circuit having a gap defined within the control valve assembly, wherein the portion of the body formed from magnetic material defines a first portion of the magnetic circuit and the portion of the plunger formed from magnetic material forms another portion of the magnetic circuit; and a solenoid mounted at the body about at least a part of the magnetic material of at least one of the body and the plunger, the solenoid being selectively activated to create a magnetic field across the gap in the magnetic circuit, the magnetic field causing the plunger to shift, narrowing the gap and disengaging from the one of the fluid inlet and the fluid outlet to produce a pressure pulse in the wellbore.

2. The control valve assembly according to claim 1, wherein the plunger includes a tapered surface.

3. The control valve assembly according to claim 1, wherein at least a part of the plunger is formed from at least one of corrosion resistant material and hard material.

4. The control valve assembly according to claim 1, wherein the plunger comprises a valve portion and a drive portion, the valve portion being formed from a non-magnetic material and the drive portion being formed from a soft magnetic material.

5. The control valve assembly according to claim 1, wherein the body includes a first body portion mechanically joined to a second body portion, the first body portion being formed from a first material and the second body portion being formed from a second material that is distinct from the first material.

6. The control valve assembly according to claim 5, wherein the second material is a soft magnetic material.

7. The control valve assembly according to claim 5, further comprising: a sleeve member mechanically linking the first body portion and the second body portion, the sleeve member defining a fluid outlet chamber fluidically connected to the fluid outlet.

8. The control valve assembly according to claim 7, wherein the sleeve member is formed from a non-magnetic material and includes one or more outlet ports fluidically connected with the fluid outlet chamber.

9. The control valve assembly according to claim 1, further comprising: a spring member biasing the plunger toward the one of the fluid inlet and the fluid outlet.

10. The control valve assembly according to claim 1, further comprising: a housing surrounding the solenoid, the housing being formed from a soft magnetic material.

11. The control valve assembly according to claim 1, further comprising: a plunger guide supported in the body, the plunger guide guiding movement of the plunger.

12. A drilling system comprising:

an uphole system; and a downhole system including a downhole string operatively connected to the uphole system, the downhole string including a pulser alternator generator having a main valve assembly, an alternator, and a control valve assembly operatively connected to the main valve assembly and the alternator, the control valve assembly comprising:

a body including a fluid passage having a fluid inlet and a fluid outlet, wherein a portion of the body is formed from magnetic material;

a plunger slidingly mounted within the body, the plunger is selectively engaged with one of the fluid inlet and the fluid outlet, wherein a portion of the plunger is formed from a magnetic material;

a magnetic circuit having a gap defined within the control valve assembly, wherein the portion of the body formed from magnetic material defines a first portion of the magnetic circuit and the portion of the plunger formed from magnetic material forms another portion of the magnetic circuit; and a solenoid mounted at the body about at least a part of the magnetic material of at least one of the body and the plunger, the solenoid being selectively activated to create a magnetic field across the gap in the magnetic circuit, the magnetic field causing the plunger to shift, narrowing the gap and disengaging from the one of the fluid inlet and the fluid outlet to produce a pressure pulse.

13. The drilling system according to claim 12, wherein the plunger includes a tapered surface.

14. The drilling system according to claim 12, wherein at least a part of the plunger is formed from at least one of corrosion resistant material and hard material.

15. The drilling system according to claim 12, wherein the plunger comprises a valve portion and a drive portion, the valve portion being formed from a non-magnetic material and the drive portion being formed from a soft magnetic material.

16. The drilling system according to claim 12, wherein the body includes a first body portion mechanically joined to a second body portion, the first body portion being formed from a first material and the second body portion being formed from a second material that is distinct from the first material.

17. The drilling system according to claim 16, wherein the second material is a soft magnetic material.

18. The drilling system according to claim 16, further comprising: a sleeve member mechanically linking the first body portion and the second body portion, the sleeve member defining a fluid outlet chamber fluidically connected to the fluid outlet.

19. The drilling system according to claim 18, wherein the sleeve member is formed from a non-magnetic material and includes one or more outlet ports fluidically connected with the fluid outlet chamber.

20. The drilling system according to claim 12, further comprising: a spring member biasing the plunger toward the one of the fluid inlet and the fluid outlet.

21. The drilling system according to claim 12, further comprising: a housing surrounding the solenoid, the housing being formed from a soft magnetic material.

22. The drilling system according to claim 12, further comprising: a plunger guide supported in the body, the plunger guide guiding movement of the plunger.

23. A method of creating a mud pulse in a downhole tool comprising:

activating a solenoid that is mounted to a body formed from a magnetic material to form a magnetic flux across a gap in a magnetic circuit formed within a control valve assembly;

narrowing the gap by moving a plunger that is formed from a magnetic material in the control valve assembly in response to the magnetic flux;

uncovering one of a fluid inlet and a fluid outlet creating a mud pressure pulse by moving the plunger; and deactivating the solenoid to cut off the magnetic flux to expand the gap.

24. The method of claim 23, wherein uncovering the one of the fluid inlet and the fluid outlet includes shifting a first end portion of the plunger formed from a non-magnetic material off away from the fluid outlet.

25. The method of claim 24, wherein forming the magnetic flux includes passing the magnetic flux through a second portion of the plunger formed from a magnetic material.

* * * * *